United States Patent [19]

Larsson et al.

[11] 4,372,484

[45] Feb. 8, 1983

[54] DEVICE FOR THE SEPARATION OF A LIQUID, ESPECIALLY WHOLE BLOOD

[75] Inventors: Lars-Ake L. Larsson, Loddekopinge, Sweden; Claes-Ake Gullberg, Hechingen, Fed. Rep. of Germany; Kaj Stenberg, Staffanstorp; Nils G. E. Boberg, Lund, both of Sweden

[73] Assignee: Gambro AB, Sweden

[21] Appl. No.: 232,024

[22] PCT Filed: Jun. 6, 1979

[86] PCT No.: PCT/SE79/00128

§ 371 Date: Feb. 4, 1981

§ 102(e) Date: Feb. 4, 1981

[87] PCT Pub. No.: WO80/02653

PCT Pub. Date: Dec. 11, 1980

[51] Int. Cl.[3] ..... B04B 11/00

[52] U.S. Cl. ..... 494/14; 422/101; 494/18

[58] Field of Search ..... 233/11, 16, 19 R, 21, 233/22, 1 R, 23 R, 25; 210/657, 198.2, 927; 128/214 R

[56] References Cited

U.S. PATENT DOCUMENTS

| | | | |
|---|---|---|---|
| 3,097,167 | 7/1963 | Beyerle | 233/23 R |
| 3,498,533 | 3/1970 | Schomburg | 233/27 |
| 3,817,449 | 6/1974 | Westberg | 233/27 |
| 3,856,669 | 12/1974 | Bowman | 210/635 |
| 3,885,735 | 5/1975 | Westbert | 233/25 |
| 3,986,442 | 10/1976 | Khoja | 74/797 |
| 4,114,802 | 9/1978 | Brown | 233/26 |

FOREIGN PATENT DOCUMENTS

| | | |
|---|---|---|
| 19038 | 11/1980 | European Pat. Off. . |
| 2833911 | 2/1979 | Fed. Rep. of Germany . |
| 558915 | 6/1923 | France . |
| 2069960 | 10/1971 | France . |
| 379481 | 10/1975 | Sweden . |

*Primary Examiner*—Robert W. Jenkins

*Attorney, Agent, or Firm*—Lerner, David, Littenberg & Samuel

[57] ABSTRACT

Apparatus for separating a liquid, such as whole blood, into fractions having different densities includes a separation chamber and a transfer device, such as a continuous piece of flexible tubing, for supplying the liquid to the separation chamber and discharging the liquid fractions therefrom. The separation chamber and the transfer device are conjointly rotated about a first axis which passes through a stationary end of the transfer device, while being simultaneously and conjointly rotated about a second axis which is coincident with a medial longitudinal axis of the rotating end of the transfer device so as to prevent the transfer device from twisting as a result of its rotation about the first axis.

23 Claims, 19 Drawing Figures

Fig.1
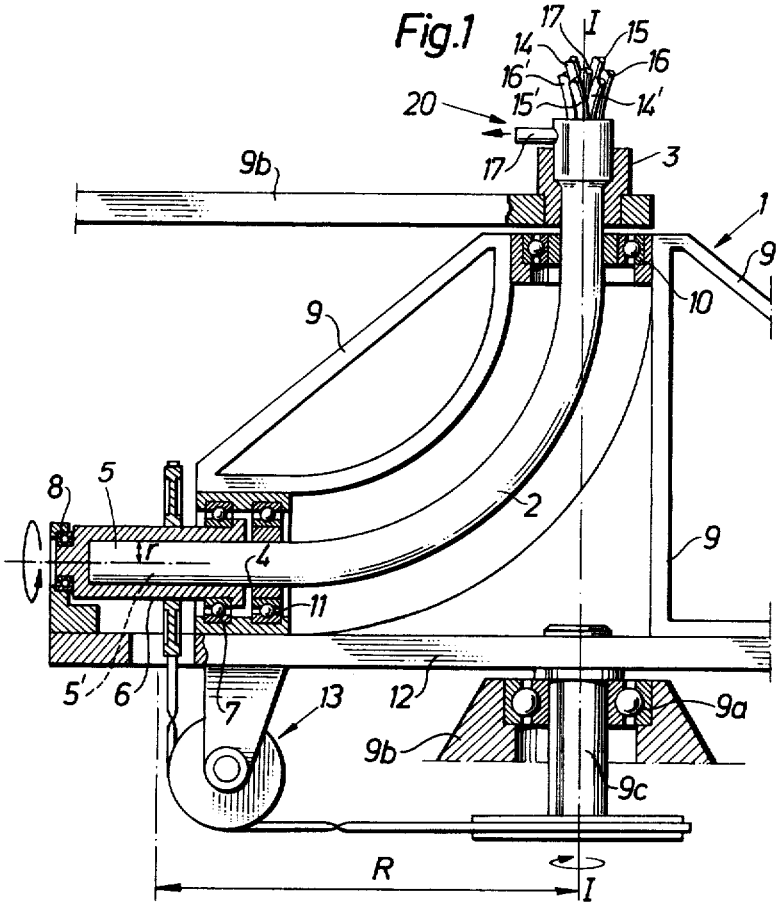
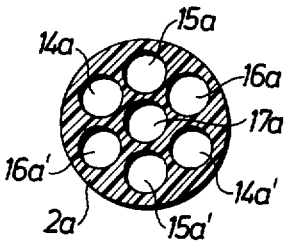
Fig.2
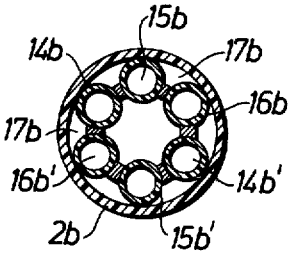
Fig.3
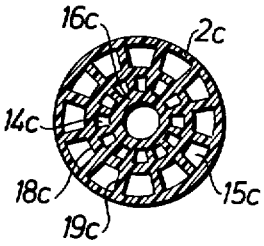
Fig.4

Fig.5
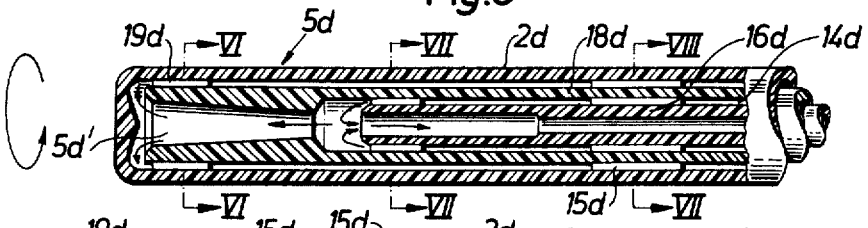
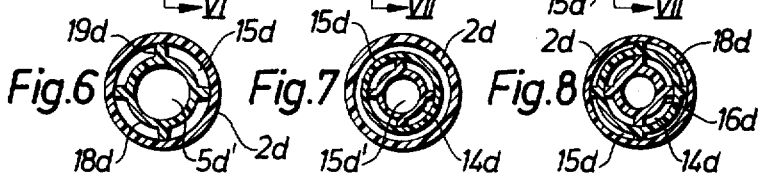
Fig.6 Fig.7 Fig.8
Fig.9
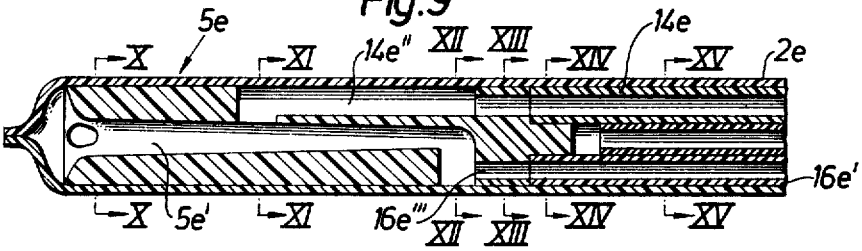
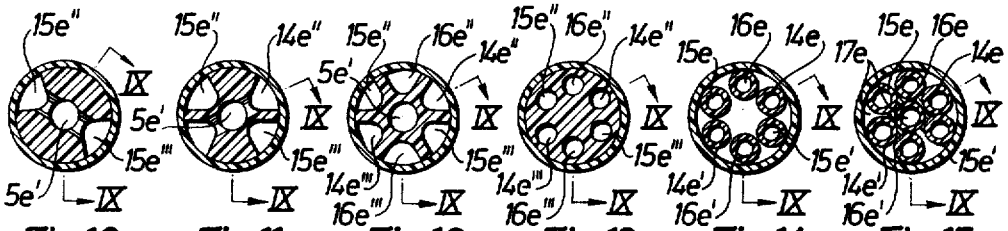
Fig.10 Fig.11 Fig.12 Fig.13 Fig.14 Fig.15
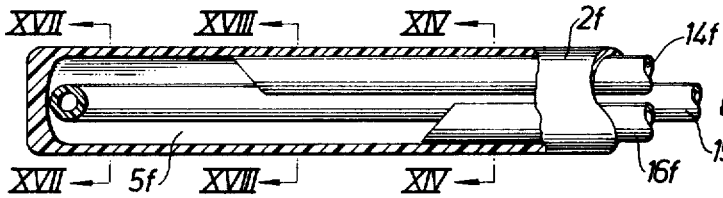
Fig.16
Fig.17 Fig.18 Fig.19
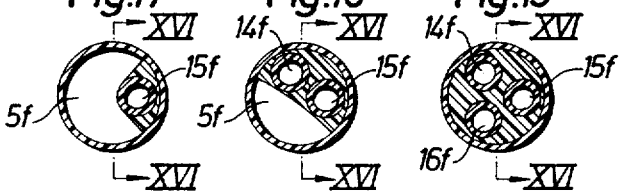

DEVICE FOR THE SEPARATION OF A LIQUID, ESPECIALLY WHOLE BLOOD

TECHNICAL FIELD

This invention relates in general to a device for the separation of a liquid into fractions having different densities. Especially, this invention relates to a device for the separation of whole blood into for example red cells and plasma.

Conveniently, the present device is of the kind that is connectable to a patient to permit the whole blood to be continuously withdrawn from said patient, to be conducted through said device and then to be reinfused into said patient. During the passage through said device said whole blood is separated into for example red cells and plasma. For example said red cells are reinfused into a patient, while said plasma is separately collected.

To the above end the present device comprises a rotatable separation unit comprising a separation chamber, and a transferring element in fluid communication with said chamber.

BACKGROUND ART

To facilitate the understanding of the present invention it may be convenient to first illustrate the nature and character of whole blood. This should however not constitute a limitation of the present invention, but should rather be taken as a convenient instrument to understand the present invention when used in one of its more special fields of use.

Whole blood is a tissue consisting of cells suspended in plasma. Said cells constitute about 45% by volume, while the remaining 55% constitutes plasma. Said suspended blood cells comprise inter alia red cells, white cells and thrombocytes. By means of the present device it is possible not only to separate cells from plasma, but also to separate said several cells from each other into separate cell fractions (so-called cytapheresis) if desired. Said separate fractions of said whole blood may be used independently for different purposes. For example said white cells are of particular concern for blood research, immunological studies and for clinical use in transplantations of organs. Furthermore, said white cells may be used for support therapy by cancer patients, the white cells of which in one or another respect have been destroyed through different anti-cancer drugs.

The red cells as well as the plasma are of particular concern for transfusion purposes.

Known devices for the separation of whole blood into different components have under favorable conditions provided a sufficient separation, but have, on the other hand, had drawbacks sometimes entailing fatal consequences for said whole blood and said separated components. The main reason has been the rotating coupling which normally is used to connect the transferring element to the rotating separation unit. Through the heat of friction which is created in rotating couplings in the contact surface between a stationary and a rotating element, said whole blood has been exposed to large temperature increases during its passage into the separation chamber. This is also true for the separated blood fractions when said fractions have passed the rotating coupling during egress from said separation unit. Even though said problem to some extent has been solved by cooling said rotating coupling with a cooling fluid, it still remains as being not completely solved.

Another drawback by said known devices, which use rotating couplings, is that blood cells may be damaged due to shear-stresses at the contact area between surfaces moving relative to each other.

The object of the present invention is therefore to provide a device of the above-mentioned kind, i.e. a device which is similar to said known devices for the separation of whole blood into fractions having different densities, which uses a rotating separation unit comprising a separation chamber, and a transferring element in fluid communication with said chamber. The present device, on the contrary, does not use rotating couplings to connect the separation unit to the transferring element.

DISCLOSURE OF INVENTION

The present device comprises a rotatable separation unit comprising a separation chamber, and a transferring element in fluid communication with said chamber. Said device is characterized in that one end of said transferring element is fixedly held, while the other end of said transferring element is rotatable together with said separation unit in a circular path around an axis through said one end.

Due to the fact that said one end of said transferring element is held fixedly, i.e. is kept stationary, while said other end is rotatable together with said separation unit around an axis through said one end, the person skilled in the art realizes that said transferring element (as well as said separation unit) will rotate around said axis (primary rotation), and also around its own longitudinal axis (secondary rotation). Said primary and said secondary rotations thereby are so synchronized that any tendency of said transferring element to be exposed to torsion or to be wound is counteracted. As regards said transferring element this fact apparently means that said transferring element will make one revolution around its own longitudinal axis per revolution around said axis through said one end of said transferring element.

Preferably, said transferring element and said separation unit are firmly held together. Consequently, also said separation unit will perform a synchronized secondary rotation with said transferring element.

Said firm connection between said transferring element and said separation unit is achieved preferably by means of a tubular casing comprising a closed end and an open end. Said casing thereby encloses at least one inlet tube for the liquid, to be separated, and at least one outlet tube for the respective fraction of said liquid. As well said inlet as said outlet tubes terminate a short distance from the closed end of said casing to form a separation chamber between the respective ends of said tubes and said closed end of said casing.

Preferably, said outlet tube for the heavy fraction terminates next to said closed end of said casing, while the outlet tubes for successively lighter fractions terminate at successively longer distances from said closed end. The inlet tube thereby terminates a longer distance from said closed end than the outlet tube for said heaviest fraction, but at a shorter distance from said closed end than the outlet tube for the lightest fraction.

In the separation of whole blood into for example red cells and plasma the inlet tube for said whole blood conveniently terminates at a point between the corresponding ends of the tubes for said red cells and said plasma, respectively.

To achieve a well balanced primary rotation the inlet tubes for said liquid and the outlet tube for the respective fractions are symmetrical about a plane containing the central longitudinal axis of said casing. This means that outlet tubes for one and the same fraction are located diametrically opposite to each other within said casing. Preferably, the inlet tube is located centrally.

According to another preferred embodiment of the present invention said tubular casing encloses two concentric tubes. The inlet for the liquid to be separated is constituted by the annular space between the innermost tube and the intermediate tube. The outlet for the heaviest fraction is in the same way formed by the annular space between said intermediate tube and said casing, while the outlet for the lightest fraction is formed by the cavity within said innermost tube.

By analogy with the first embodiment said innermost tube terminates at a point which is a farther distance from the closed end of said casing than the distance between said closed end and said intermediate tube.

The number of concentric tubes to be used depends in each separate case on the number of desired fractions. This preferred embodiment in general is very similar to said first embodiment and need therefore not be described in more detail. Yet it is to be noted that suitable spacers may be provided between the tubes to keep said tubes in place. For example protruding heels, frameworks and similar constructions may be provided on the outer surfaces of the concentric tubes to prevent said tubes from contacting each other and thereby clogging said annular spaces or channels.

Alternatively, said firm connection between said transferring element and said separation unit is realized by means of a tubular body comprising a closed and an open end. Said tubular body comprises at least one inlet channel (longitudinal void) for the liquid to be separated and at least one outlet channel (longitudinal void) for the respective fraction of said liquid. Said channels terminate a distance from said closed end of said tubular body to form a separation chamber between the respective ends of said channels and said closed end of said tubular body. Again, this alternative embodiment is very similar to said first embodiment and therefore need not be described more in detail.

Still another embodiment of the present invention comprises a separation unit in the form of a separate hollow body which is fixedly connected to said transferring element. Said hollow body is preferably molded and comprises cavities in communication with tubes or channels in said transferring element. As well said molded separation unit as said transferring element are conveniently encapsulated within a tubular housing comprising a closed and an open end. The principal difference between this embodiment and the embodiments described hereabove is that the separation chamber in this case is formed by cavities in an individual molded hollow body, while the corresponding chambers in the preceding embodiments are formed by the space between said transferring element and said closed end of said enclosing casing. This embodiment also does not need to be discussed in more detail.

Although not necessary, said separation unit conveniently is carried in a rotatable support casing which is adapted to be rotated together with said separation unit around said axis through said fixedly held end of said transferring element. Thereby a smooth and vibration free primary rotation is achieved. As an extra matter of safety against vibrations and possible unbalances during said primary rotation said support casing is preferably driven by means of separate driving means which in turn are adapted to be driven in synchronism with the secondary rotation of said transferring element. Said driving means are preferably coupled to the motor that provides for the primary rotation of said transferring element.

Preferably, said transferring element is provided in a curved path and supported in this position by means of suitable supporting means. As well said support casing as said separation unit may be manufactured from transparent material making it possible to visually (for example by means of a stroboscope) watch the separation of whole blood within said separation chamber.

Finally, said transferring element may comprise flowing channels for a cooling liquid, for example salt solution, which is adapted to withdraw heat that may be generated through shearing in said transferring element due to bending of tubes during said secondary rotation.

The present invention will be described in more detail with reference to the accompanying drawings, wherein FIG. 1 is a schematic view of the present device together with suitable accessories, FIGS. 2–4 are cross-sections of preferred transferring elements according to the present invention, FIG. 5 is a schematic illustration, partly in section, of a preferred transferring element which is firmly connected to a separation unit, FIGS. 6–8 are cross-sections of the transferring element and the separation unit of FIG. 5 along lines VI—VI, VII—VII and VIII—VIII in FIG. 5, FIG. 9 is a schematic illustration, partly in section, of a second preferred transferring element which is connected to an individual separation unit, taken along lines IX—IX in FIGS. 10–15, FIGS. 10–15 are cross-sections of the separation unit and the transferring element of FIG. 9, taken along lines X—X, XI—XI, XII, XIII, XIV, and XV—XV, and FIG. 16 is a schematic view, partly in section, of a further transferring element according to the present invention, taken along lines XVI—XVI in FIGS. 17–19, and wherein FIGS. 17–19 are cross-sections of the transferring element of FIG. 16, taken along lines XVII—XVII, XVIII—XVIII and XIX—XIX in FIG. 16.

As is shown in FIG. 1, the present device, generally designated 1, comprises a transferring element 2 which at its one end 3 is held fixedly and at its other end 4 is connected to a separation unit 5 comprising a separation chamber 5'.

Said separation unit 5 is preferably carried in a support casing 6 which is rotatable around its own longitudinal axis by means of a bearing 7, 8.

Between its two ends 3 and 4 said transferring element 2 is provided in a curved path and kept in this position by means of a stand 9 and suitable support bearings 10, 11 attached to said stand and permitting said transferring element 2 to rotate freely around its own longitudinal axis. Said stand 9 is carried on a stationary support plate 12 and is rotatable around an axis through said fixedly held end 3 of said transferring element. Said axis is designated I—I in FIG. 1. The rotation around said axis I—I is provided by means of a not shown drive motor via a drive shaft **9*c* which is carried in a bearing 9*a* in a supporting means 9*b***.

To the right part (not shown) of said stand 9 in FIG. 1 a counter-weight may be provided to balance said transferring element 2 and said separation unit 5, when said stand 9 is rotating. Thereby, vibrations due to asymmetric weight distribution are avoided.

Said separation unit 5 as well as said support casing 6 are preferably transparent. Thereby it is possible to visually (for example by means of a stroboscope) watch the separation and, if necessary, to control the rotational speed, so that the best possible separation is achieved. Althernatively, said separation may be controlled by controlling the introduction and/or withdrawal of liquid in said different inlet and outlet tubes. For examples, if whole blood is to be separated into plasma and red cells and the volume of plasma within said separation chamber apparently is too big, then said volume may be reduced by either increasing the withdrawal rate of plasma or by reducing the withdrawal rate of red cells. Polyvinylchloride (PVC) is a suitable transparent material.

A further way of controlling said separation comprises the choice of suitable rotation radius R from said axis I—I.

Depending on the liquid to be separated, it may be convenient to use a larger or smaller ratio between radius R of said separation chamber 5' and radius R of the primary rotation of said separation chamber 5', i.e. the distance between said axis I—I and said separation unit 5. In the separation of whole blood into red cells and plasma, said ratio conveniently is between 30:1 and 15:1. In this way the influence of the secondary rotation of said separation unit on said separation may be more or less used and thereby the separation be initiated prior to entering into said separation chamber 5'.

To aviod unbalances due to vibrations of said support casing 6, said casing may be driven separately by means of schematically shown drive means, generally designated 13, which are synchronically driven by the not shown drive motor for said stand 9.

In FIGS. 2–4 suitable cross-sections are shown, which may be used for said transferring element 2.

In FIG. 2 said transferring element consists of a tubular body 2a having perforated holes or channels 14a, 14a', 15a, 15a', 16a, 16a' and 17a. As is shown in FIG. 2 said channels are symmetrical about a plane containing the central longitudinal axis of said tubular body 2a. In the separation of whole blood, said channels 14a, 14a' constitute inlet channels for said whole blood, while said channels 15a, 15a' and 16a, 16a' constitute outlet channels for the red blood cells and the plasma, respectively. The central channel 17a may either form a third inlet channel for said whole blood, or a separate flowing channel for cooling liquid, if necessary.

In FIG. 3 said transferring element consists of a tubular housing 2b enclosing six individual tubes 14b, 14b', 15b, 15b', 16b, 16b'. Said tubes are symmetrical about a plane containing the central longitudinal axis of said casing and attached to each other to maintain the shown position. Said tubes form in pairs inlet and outlet tubes for the whole blood and the separated fractions, respectively. For example, said tubes 14b, 14b' are inlet tubes for said whole blood, while the tubes 15b, 15b' and 16b, 16b' are outlet tubes for red blood cells and plasma, respectively.

The space 17b between said tubes and said casing 2b forms flowing channels for a cooling liquid, for example isotonic 0.9% NaCl solution.

In FIG. 4 said transferring element consists of an outer tubular casing 2c enclosing concentric tubes 16c, 18c. Said casing 2c and said tubes 16c and 18c thereby form annular spaced or channels 14c, 15c. Said annular space 15c between said casing 2c and the intermediate tube 18c forms an outlet channel for the heaviest fraction (red blood cells), while the annular space 14c between said intermediate tube 18c and the innermost tube 16c forms an inlet tube for said whole blood. The cavity in the innermost tube 16c consequently forms an outlet channel for said plasma. As mentioned before the number of concentric tubes, to be used, may vary from case to case and is dependent on the number of fractions that is desired.

To maintain the concentric arrangement of said casing 2c and said tubes 16c and 18c, said intermediate tube 18c may be provided with protruding heels 19c abutting the inner surface of said casing 2c and the outer surface of the innermost tube 16c, respectively. Thereby is avoided that said tubes will contact each other and clog the annular spaces 14c and 15c, when said transferring element is rotating around said axis I—I.

As well said tubular body 2a as said casings 2b and 2c are manufactured from a flexible material. A preferred example of such material is silicon rubber which is also sufficiently firm to withstand shearing due to the primary rotation of said transferring element.

The transferring element and the separation unit shown in FIGS. 5–8 correspond generally to the transferring element shown in FIGS. 1 and 4. The same reference numbers as those in FIGS. 1 and 4 have therefore been used, except for the addition of the letter "d" instead of the letter "c". In FIG. 5 said separation unit is designated 5d, said separation chamber is designated 5d' and said transferring element (including said tubular casing) is designated 2d. Reference is also made to the above description in connection with FIG. 4.

The transferring element and the separation unit of FIGS. 9–15 differ from the construction shown in FIG. 5 primarily in that said separation unit 5e is formed as a separate molded unit. Said transferring element 2e has in general the same cross-section as that of FIG. 3. For similar parts the same reference numbers have therefore been used, except for the addition of the letter "e". The channels in said separation unit 5e have therefore been designated in the same way as the corresponding tubes in the transferring element 2e, except for the addition of double prime and triple prime.

The transferring element 2f (including the separation unit 5f) of FIG. 16 is the simplest possible realization of said transferring element having the cross-section shown in FIG. 3. The same reference numbers as those in FIG. 3 have therefore been used, except for the addition of the letter "f". Thus, the transferring element comprises only three tubes, designated 14f, 15f, 16f. The inlet tube for the liquid to be separated is designated 14f, while the outlet tubes for the red cells and the plasma are designated 15f and 16f, respectively.

In connection with FIG. 5 the operation of the present device will be described when used in the separation of whole blood. Said whole blood, to be separated into red blood cells and plasma, is introduced through the annular space 14d between the innermost tube 16d and the intermediate tube 18d. Due to the secondary rotation of said transferring element, shown by the arrow to the left of FIG. 5, said whole blood will be exposed to preseparation prior to entering into said separation chamber 5d' in such a manner that said plasma tends to concentrate towards the longitudinal axis of said transferring element 2d, while the heavier red blood cells correspondingly tend to concentrate away from said longitudinal axis within said space 14d. The so partly separated whole blood enters into said separation chamber 5d', where the proper separation occurs. Due to the centrifugal forces the heavier red blood cells will be concentrated peripherally outwardly (to the left of FIG. 5), while the lighter plasma will be concentrated towards the center and will enter into the cavity in said outlet tube 16*d*. The flowing conditions for said whole blood, said red cells and said plasma are shown by arrows in FIG. 5. Due to the fact that whole blood is continuously introduced into said space 14*d* the separated red blood cells and the plasma correspondingly are continuously withdrawn through the annular space 15*d* and the cavity in said outlet tube 16*d*, respectively. Since neither the way in which said whole blood is introduced into said transferring element 2*d* and said separation unit 5*d* or the way in which the separated fractions are withdrawn from said unit constitute any essential part of the present invention, no further description thereof is therefore needed. Briefly, the arrangement 20 of FIG. 1 corresponds in general to the construction of FIGS. 9–15. The same reference numbers for similar parts have therefore been used, yet without the addition of any letter.

Even if the present invention has been described with particular reference to the separation of whole blood, it is to be understood that the present invention is also applicable to other liquids, containing fractions of different densities, which are to be separated into said fractions.

INDUSTRIAL APPLICABILITY

As is realized from the above description, the present device is especially, though not exclusively, useful in the separation of whole blood into for example red blood cells and plasma. Said whole blood is thereby continuously introduced into said device from an outer source, for example a patient, and is separated under the influence of centrifugal forces in a rotatable separation unit. The separated fractions, red blood cells and plasma, are withdrawn from said separation chamber within said separation unit through individual tubes and are reinfused into said patient or are collected selectively. Due to the fact that one end of said transferring element is held fixedly, while the other end thereof (i.e. the end which is in fluid communication with said separation chamber) is rotatably connected to said chamber, rotating couplings are thereby avoided, which due to heat of friction may expose said blood and the separated fractions to excessive and detrimental temperature increases and/or detrimental shear stresses.

We claim:

1. Apparatus for separating a liquid, such as whole blood, into fractions having different densities, comprising separating means for separating the liquid into its fractions, said separating means including a separation chamber;

transferring means in fluid communication with said separation chamber of said separating means for transferring the liquid to said separation chamber and for individually transferring the liquid fractions from said separation chamber, said transferring means including supplying means for supplying the liquid to said separation chamber, first discharging means separate and distinct from said supplying means for discharging a first liquid fraction from said separation chamber, and second discharging means separate and distinct from said supplying means and said first discharging means for discharging a second liquid fraction from said separation chamber, whereby the first and second liquid fraction may be individually discharged from said separation chamber by said first and second discharging means, respectively, said transferring means further including a first end which is stationary and a second end which is rotatable in a circular path around and at a distance from a first axis passing through said first end of said transferring means, said second end of said transferring means being fixedly connected to said separating means, whereby said separating means is rotatable conjointly with said second end of said transferring means about said first axis and about a second axis which is coincident with a medial longitudinal axis of said second end of said transferring means; and rotating means for conjointly rotating said separating means and said second end of said transferring means about said first axis and for conjointly rotating said separating means and said second end of said transferring means about said second axis so as to prevent said transferring means from twisting as a result of its rotation about said first axis.

2. Apparatus according to claim 1, wherein said transferring means includes a tubular casing having a closed end which defines said separation chamber; said supplying means includes at least one inlet tube positioned within said tubular casing and fixedly connected thereto, each inlet tube being in fluid communication with said separation chamber, whereby the liquid may be supplied to said separation chamber through at least one inlet tube; said first discharging means includes a first outlet tube positioned within said tubular casing and fixedly connected thereto, said first outlet tube being in fluid communication with said separation chamber, and said second discharging means includes a second outlet tube positioned within said tubular casing and fixedly connected thereto, said second outlet tube being in fluid communication with said separation chamber, whereby the first and second liquid fractions may be individually discharged from said separation chamber through said first and second outlet tubes, respectively.

3. Apparatus according to claim 2, wherein said one outlet tube terminates at a point which is adjacent to said closed end of said tubular casing and said second outlet tube terminates at a point which is a first distance from said closed end of said tubular casing, whereby said first outlet tube discharges the first liquid fraction and said second outlet tube discharges the second liquid fraction which is less dense than the first liquid fraction.

4. Apparatus according to claim 3, wherein said at least one inlet tube terminates at a point which is a second distance from said closed end of said tubular casing, said second distance being less than said first distance.

5. Apparatus according to claim 4, wherein there are a pair of inlet tubes, said inlet tubes being arranged on diametrically opposite sides of said tubular casing from each other; said first discharging means includes a third outlet tube positioned within said tubular casing diametrically opposite said first outlet tube, said third outlet tube being fixedly connected to said tubular casing and terminating at a point which is adjacent to said closed end of said tubular casing; and said second discharging means includes a fourth outlet tube positioned within said tubular casing diametrically opposite said second outlet tube, said fourth outlet tube being fixedly connected to said tubular casing and terminating at a point which is said first distance from said closed end of said tubular casing, whereby the liquid may be transferred to said separation chamber through said inlet tubes, the first liquid fraction may be transferred from said separation chamber through said first and third outlet tubes, and the second liquid fraction may be transferred from said separation chamber through said second and fourth outlet tubes.

6. Apparatus according to claim 2, 3, 4 or 5, wherein said inlet and outlet tubes are arranged within said tubular casing such that said inlet and outlet tubes cooperate with said tubular casing to form a plurality of channels within said tubular casing.

7. Apparatus according to claim 6, further comprising means for flowing coolant through said channels.

8. Apparatus according to claim 1, wherein said transferring means includes a tubular casing having a closed end which defines said separation chamber; a first tube arranged coaxially with respect to said tubular casing; a second tube arranged coaxially with respect to said tubular casing and positioned between said first tube and said tubular casing; a first annular channel formed between said tubular casing and said second tube; and a second annular channel formed between said first and second tubes, whereby said second channel forms said supplying means so that the liquid may be supplied to said separation chamber through said second annular channel, said first annular chamber forms said first discharging means so that the first liquid fraction may be discharged from said separation chamber through said first annular channel, and said first tube forms said second discharging means so that the second liquid fraction may be discharged from said separation chamber through said first tube.

9. Apparatus according to claim 8, wherein said first tube terminates a first distance from said closed end of said tubular casing and said second tube terminates a second distance from said closed end of said tubular casing, said second distance being less than said first distance.

10. Apparatus according to claim 1, wherein said transferring means includes a tubular casing having a closed end which defines said separation chamber; said supplying means includes at least one inlet channel formed in said tubular casing, each inlet channel being in fluid communication with said separation chamber, whereby the liquid may be supplied to said separation chamber through said at least one inlet channel; said first discharging means includes a first outlet channel formed in said tubular casing, said first outlet channel being in fluid communication with said separation chamber, and said second discharging means includes a second outlet channel formed in said tubular casing, said second outlet channel being in fluid communication with said separation chamber, whereby the first and second liquid fractions may be individually discharged from the separation chamber through said first and second outlet channels, respectively.

11. Apparatus according to claim 10, wherein there is at least a pair of outlet channels, one for the most dense liquid fraction and the other for the least dense liquid fraction, said one outlet channel terminating at a point adjacent to said closed end of said tubular casing and said other outlet channel terminating a first distance from said closed end of said tubular casing.

12. Apparatus according to claim 11, wherein said at least one inlet channel terminates at a point which is a second distance from said closed end of said tubular casing, said second distance being less than said first distance.

13. Apparatus according to claim 12, wherein there are a pair of inlet channels, said inlet channels being arranged on diametrically opposite sides of said tubular casing from each other; a first pair of outlet channels, said outlet channels of said first pair of outlet channels being arranged on diametrically opposite sides of said tubular casing from each other; and a second pair of outlet channels, said outlet channels of said second pair of outlet channels being arranged on diametrically opposite sides of said tubular casing from each other, whereby the liquid may be transferred to said separation chamber through said inlet channels, the most dense liquid fraction may be transferred from said separation chamber through said first pair of outlet channels, and the least dense liquid fraction may be transferred from said separation chamber through said second pair of outlet channels.

14. Apparatus according to claim 10, 11, 12 or 13, wherein said tubular casing further includes at least one additional channel.

15. Apparatus according to claim 14, further comprising means for flowing a coolant through each of said additional channels.

16. Apparatus according to claim 1, wherein said separating means is formed integrally with said transferring means, said separating means including a hollow insert fixedly connected to said transferring means and defining said separation chamber.

17. Apparatus according to claim 1, further comprising supporting means for supporting said transferring means such that said transferring means has a curvilinear shape.

18. Apparatus according to claim 1, wherein said rotating means includes first rotating means for conjointly rotating said separating means and said second end of said transferring means about said first axis and second rotating means for conjointly rotating said separating means and said second end of said transferring means about said second axis so as to prevent said transferring means from twisting as a result of its rotation about said first axis.

19. Apparatus according to claim 18, wherein said second rotating means includes a rotatable casing which encloses said separating means, said casing being fixedly connected to said separating means.

20. Apparatus according to claim 19, wherein said casing and said separating means are transparent, whereby the separation of the liquid into its fractions may be observed.

21. Apparatus according to claim 1, wherein said separating means and said transferring means are formed from a single continuous piece of flexible tubing.

22. Apparatus for separating a liquid, such as whole blood, into fractions having different densities, comprising separating means for separating the liquid into its fractions, said separating means including a separation chamber;

transferring means formed integrally with said separating means and in fluid communication with said separation chamber thereof for transferring the liquid to said separation chamber and for individually transferring the liquid fractions from said separation chamber, said transferring means including a hollow insert connected thereto to define said separation chamber, a first end which is stationary and a second end which is rotatable in a circular path around and at a distance from a first axis passing through said first end of said transferring means, said second end of said transferring means being fixedly connected to said separating means, whereby said separating means is rotatable conjointly with said second end of said transferring means about said first axis and about a second axis which is coincident with a medial longitudinal axis of said second end of said transferring means; and rotating means for conjointly rotating said separating means and said second end of said transferring means about said first axis and for conjointly rotating said separating means and said second end of said transferring means about said second axis so as to prevent said transferring means from twisting as a result of its rotation about said first axis.

23. Apparatus for separating a liquid, such as whole blood, into fractions having different densities, comprising separating means for separating the liquid into its fractions, said separating means including a separation chamber;

transferring means in fluid communication with said separation chamber of said separating means for transferring the liquid to said separation chamber and for individually transferring the liquid fractions from said separation chamber, said transferring means including a first end which is stationary and a second end which is rotatable in a circular path around and at a distance from a frist axis passing through said first end of said transferring means, said second end of said transferring means being fixedly connected to said separating means, whereby said separating means is rotatable conjointly with said second end of said transferring means about said first axis and about a second axis which is coincident with a medial longitudinal axis of said second end of said transferring means, said transferring means and said separating means being formed from a single continuous piece of flexible tubing; and rotating means for conjointly rotating said separating means and said second end of said transferring means about said first axis and for conjointly rotating said separating means and said second end of said transferring means about said second axis so as to prevent said transferring means from twisting as a result of its rotation about said first axis.

* * * * *